US006497109B1

(12) United States Patent
Nishizuka et al.

(10) Patent No.: US 6,497,109 B1
(45) Date of Patent: Dec. 24, 2002

(54) AIR CONDITIONER

(75) Inventors: Toshiharu Nishizuka, Kyoto (JP); Yuji Takeda, Otsu (JP); Daisuke Tabata, Kusatsu (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/719,964

(22) PCT Filed: May 31, 1999

(86) PCT No.: PCT/JP99/02907

§ 371 (c)(1),
(2), (4) Date: Dec. 19, 2000

(87) PCT Pub. No.: WO99/66205

PCT Pub. Date: Dec. 23, 1999

(30) Foreign Application Priority Data

| | | |
|---|---|---|
| Jun. 19, 1998 | (JP) | 10-189820 |
| Dec. 24, 1998 | (JP) | 10-365808 |
| Dec. 25, 1998 | (JP) | 10-368335 |

(51) Int. Cl.[7] ..... F25B 49/00
(52) U.S. Cl. ..... 62/230; 62/228.4
(58) Field of Search ..... 62/126, 127, 129, 62/130, 230, 228.1, 228.3, 228.4, 228.5

(56) References Cited

U.S. PATENT DOCUMENTS 5,018,058 A 5/1991 Ionescu et al. ..... 363/34

FOREIGN PATENT DOCUMENTS

| | | |
|---|---|---|
| EP | 0 652 634 A2 | 5/1995 |
| EP | 0 695 024 A2 | 1/1996 |
| EP | 0 820 136 A2 | 1/1998 |
| JP | 62040091 | 2/1987 |
| JP | 62-238938 | 10/1987 |
| JP | 1016297 | 1/1989 |
| JP | 64-16297 | 1/1989 |
| JP | 01313681 | 12/1989 |
| JP | 2-78759 | 6/1990 |
| JP | 05184180 | 7/1993 |
| JP | 7-163182 | 6/1995 |
| JP | 10131859 | 10/1996 |
| JP | 9-264260 | 10/1997 |
| JP | 11014124 | 1/1999 |

*Primary Examiner*—Harry B. Tanner
(74) *Attorney, Agent, or Firm*—Parkhurst & Wendel, L.L.P.

(57) ABSTRACT

An air conditioner capable of improving its assembling efficiency and reducing material costs. The air conditioner reduces the effects of the fluctuation in commercial line voltage (12) on the supply voltage to a compressor (11), while reducing the vibrations of its outdoor unit (2). The outdoor unit (2) is provided with a voltage correction circuit (14) that maintains the output voltage to the compressor (11) constant (optimal) regardless of the changes in voltage on commercial power supply line (12).

4 Claims, 10 Drawing Sheets

AIR CONDITIONER

TECHNICAL FIELD

The present invention relates to a separate-type air conditioner that comprises a separate indoor unit and outdoor unit connected electrically.

BACKGROUND ART

As shown in FIG. 13, an electric circuit of a conventional air conditioner capable of cooling and heating comprising an indoor unit 1, an outdoor unit 2, and an indoor-outdoor connector cable 3 connecting them electrically. The indoor unit 1 comprises a main switch 4, an indoor electronic controller 5, an indoor fan motor 6 such as a transistor motor, and a louver motor 7 for driving upper and lower indoor blades. The outdoor unit 2 comprises an outdoor electronic controller 8, a four-way valve 9 for switching a refrigerant flow path according to refrigerating and heating cycles, an outdoor fan motor 10 such as an induction motor, and a compressor 11 for compressing the refrigerant.

The operation of this conventional air conditioner will be described below.

The indoor unit 1 is connected to the commercial power supply 12. When the main switch 4 on the indoor unit 1 is turned on, power is supplied to the indoor electronic controller 5, which starts control operation and activates the indoor fan motor 6 and the louver motor 7 to start circulating indoor air through an indoor heat exchanger (not shown). Now if the user gives an operation start command, the indoor electronic controller 5 connects the outdoor unit 2 with the commercial power supply 12 by means of the main relay (not shown) to supply power to it. Receiving power from the commercial power supply 12, the outdoor electronic controller 8 starts control operation: it applies control voltage to the compressor 11 to start its rotation and connects the outdoor fan motor 10 with the commercial power supply 12 to start sending outdoor air to an outdoor heat exchanger (not shown). When the commercial power supply 12 is not connected, the four-way valve 9 for switching the refrigerant flow path is positioned to pass the refrigerant to the cooling-cycle path under instructions from the outdoor electronic controller 8. In this state, the air conditioner starts cooling operation.

Next, when the user specifies heating, the commercial power supply 12 is connected to the four-way valve 9 under instructions from the outdoor electronic controller 8. This operation switches the refrigerant flow path to the heating-cycle side to make heating to be started. The out door fan motor 10 sends outdoor air to the outdoor heat exchanger, which extracts heat from the outdoor air into the refrigerant, which consequently vaporizes, is compressed by the compressor 11, and is sent to the indoor heat exchanger.

In either case, the outdoor electronic controller 8 amplifies or attenuates the commercial power supply 12 in accordance with the operating frequency of the compressor 11 and applies the resulting voltage to the compressor 11.

However, with the configuration of the conventional air conditioner, in which the output voltage to the compressor solely depends on the voltage of the commercial power supply, voltage variations in the commercial power supply will fluctuate the output voltage to the compressor, which may result in a failure to start the compressor. To eliminate this disadvantage, the output signal to the compressor should be set at a little larger value, which, however, may increase the vibration of the output unit at a start-up and during an operation. To deal with this situation, currently a vibration damping part such as Coal Tape, etc. is used in large quantities for the piping of the outdoor unit or a loop-like shape is given to the piping for vibration damping. However, this increases material costs and requires a large number of manhours during assembly, resulting in poor workability. Moreover, shifts in the operating point of the compressor will degrade the efficiency of the compressor, resulting in increased power consumption. Also, if the compressor is not pressure balanced during restarting, optimum voltage will not be applied. Therefore, a compressor with a dc motor may fail to restart due to insufficient starting torque.

An object of the present invention is to provide an air conditioner and its operation control method that will reduce the effect of voltage fluctuations in commercial power supply and ensure accurate compressor operation. Another object of the present invention is to provide an air conditioner and its operation control method that will improve the starting force of the compressor considering its starting load while reducing the effect of voltage fluctuations in the commercial power supply on the compressor.

DISCLOSURE OF THE INVENTION

To attain the above objects, a separate-type air conditioner according to the present invention contains a correction circuit of output voltage to a compressor in an outdoor unit. This voltage correction circuit keeps the output voltage to the outdoor unit constant (optimum) despite voltage fluctuations in a commercial power supply, making it possible to largely reduce the use of vibration damping material such as Coal Tape and simplify the shape of pipings while maintaining vibration of the outdoor unit at low levels, and thus providing the advantages of reduced material costs and improved working efficiency during assembly operations.

More particularly, the separate-type air conditioner according to the present invention connects the indoor and outdoor units electrically to each other by means of an indoor-outdoor connector cable and contains a correction circuit of the output voltage to the compressor in the outdoor unit to keep the output voltage to the outdoor unit constant by correcting fluctuations in the voltage of the commercial power supply. Since the correction circuit of the output voltage to the compressor keeps the output voltage to the outdoor unit constant, the vibration of the outdoor unit is maintained at low levels, resulting in reduced material costs and improved working efficiency during assembly operations.

The voltage correction circuit of the separate-type air conditioner according to the present invention comprises voltage detection means for detecting input voltage, reception means for receiving an input voltage signal outputted by the voltage detection means, a timer and an arithmetic circuit for averaging the input voltage signal received by the reception means within a specified time period, and determination means and the arithmetic circuit for voltage correction control in order for correcting and determining the output voltage to the compressor. Since the timer, arithmetic circuit, and determination means can keep the output voltage to the compressor constant, the vibration of the outdoor unit is maintained at low levels, resulting in reduced material costs and improved working efficiency during assembly operations.

The voltage correction circuit of the separate-type air conditioner according to the present invention comprises voltage detection means for detecting input voltage, reception means for receiving an input voltage signal outputted by the voltage detection means, and determination means for voltage correction control in order for correcting and determining the output voltage to the compressor based on the input voltage signal and by means of a data table. The use of the data table instead of the arithmetic circuit for obtaining optimum output voltage to the compressor from the input voltage signal has the effect of reducing capacity requirements of a micro computer and further reducing material costs.

The voltage correction circuit of the separate-type air conditioner according to the present invention comprises voltage detection means for detecting input voltage as well as determination means and an arithmetic circuit for voltage correction control in order fore correcting and determining the output voltage to the compressor by making corrections for loads, based on an outside air temperature detection signal outputted from outside air temperature detection means installed in the outdoor unit and a room air temperature detection signal outputted from room air temperature detection means installed in the indoor unit. The measurement of outside air temperature and room air temperature clarifies the working loads on the separate-type air conditioner, and thus makes it possible to optimize the output voltage to the compressor, taking the effect of loads into consideration.

An operation control method of the separate-type air conditioner according to the present invention comprises the steps of controlling a duty of the commercial power supply, converting the duty into a power supply signal according to a voltage value of the commercial power supply, and applying a resulting power supply signal to a power supply circuit of the compressor. This allows the output voltage to the compressor to be optimized irrespective of voltage fluctuations in a commercial power supply, ensuring an accurate start-up and an efficient operation of the compressor.

More particularly, the start control method of the air conditioner according to the present invention operates the compressor for a refrigerating cycle by controlling the duty of the commercial power supply, converting the duty into a power supply signal according to a voltage value of the commercial power supply, and applying a resulting power supply signal to a power supply circuit of the compressor. This provides the capability to optimize the output voltage to the compressor irrespective of the voltage fluctuations in the commercial power supply, ensuring an accurate start-up of the compressor as well as the capability to maintain the vibration of the outdoor unit at low levels, resulting in reduced material costs and improved working efficiency during assembly operations. Besides, the compressor can always be operated efficiently.

The separate-type air conditioner according to the present invention is operated by the steps of controlling a duty of a commercial power supply, converting the duty into a power supply signal according to a voltage value of the commercial power supply, and applying a resulting power supply signal to a power supply circuit of a compressor, wherein a voltage correction controller is provided in order for correcting and determining an optimum output voltage to the compressor by allocating a duty data for determination of the output voltage to the compressor to one of high-voltage, rated-voltage and low-voltage region tables or to one of high-voltage and low-voltage region tables according to input voltage. This provides the capability to optimize the output voltage to the compressor despite the voltage fluctuations in the commercial power supply, ensuring an accurate start-up of the compressor as well as the capability to maintain the vibration of the outdoor unit at low levels, resulting in reduced material costs and improved working efficiency during assembly operations. Besides, the compressor can always be operated efficiently.

The air conditioner according to the present invention comprises detection means for detecting load conditions to allow the voltage correction controller to modify the duty data based on the load conditions to correct and determine the optimum output voltage to the compressor. Thus, it can detect the load conditions of the air conditioner, and consequently optimize the output voltage to the compressor taking into consideration the effect of the load conditions on the output voltage to the compressor.

The air conditioner according to the present invention comprises voltage/current detection means for detecting the output voltage and output current to the compressor to allow the voltage correction controller to modify the duty data based on the output voltage and output current detected by the voltage/current detection means to correct and determine the optimum output voltage to the compressor. Thus, it can clarify the load conditions of the air conditioner, and consequently optimize the output voltage to the compressor taking into consideration the effect of the loads on the output voltage to the compressor.

A start control method of an air conditioner according to the present invention starts the compressor by the steps of applying a power supply signal set according to the voltage value of a commercial power supply at a start-up time and corrected based on a suspension period of the compressor to the power supply circuit of the compressor. This makes it possible to reduce the effect of the loads on the output voltage to the compressor as well as to improve the starting force of the compressor taking into consideration the compressor loads at the start-up time.

More particularly, the start control method of the air conditioner according to the present invention starts the compressor for a refrigerating cycle by applying the power supply signal set according to the voltage value of the commercial power supply at the start-up time and corrected based on the suspension period of the compressor to the power supply circuit of the compressor. This makes it possible to reduce the effect of the loads on the output voltage to the compressor as well as to improve the starting force of the compressor taking into consideration the compressor loads at the start-up.

An air conditioner according to the present invention, which starts the compressor by applying a power supply signal set according to a voltage value of a commercial power supply at a start-up time to a power supply circuit of the compressor, comprises a voltage correction controller for correcting the power supply signal and determining an optimum output voltage to the compressor based on a suspension period of the compressor. This makes it possible to reduce the effect of loads on the output voltage to the compressor as well as to improve the starting force of the compressor taking into consideration the compressor loads at the start-up time.

The air conditioner according to the present invention comprises shell temperature detection means for detecting a shell temperature of the compressor to allow the voltage correction controller to correct and determine the optimum output voltage to the compressor based on a detection signal from the shell temperature detection means. By detecting the shell temperature of the compressor and determining the optimum output voltage to the compressor taking into consideration magnetic characteristics of a dc motor, it is possible to further improve the starting force of the compressor.

The air conditioner according to the present invention has the voltage correction controller configured to correct and determine the optimum output voltage to the compressor based on a room air temperature detection signal outputted from the room air temperature detection means and an outside air temperature detection signal outputted from the outside air temperature detection means. By detecting the room air temperature and outside air temperature and correcting the optimum output voltage to the compressor taking into consideration the characteristics of a refrigerant at the start-up time after a long-term shutdown, it is possible to optimize the output voltage to the compressor.

A start control method of the air conditioner according to the present invention starts a compressor for a refrigerating cycle by the steps of controlling a duty of a commercial power supply, converting the duty into a power supply signal according to a voltage value of the commercial power supply, and applying a resulting power supply signal to a power supply circuit of the compressor with the duty corrected according to a suspension period of the compressor. This makes it possible to reduce the effect of voltage fluctuations in the commercial power supply on the output voltage to the compressor as well as to improve the starting force of the compressor taking into consideration the compressor loads at the start-up time.

DESCRIPTION OF THE EMBODIMENTS

Embodiments of the present invention will be described below with reference to the accompanying drawings.

(Embodiment 1)

Figure 1:
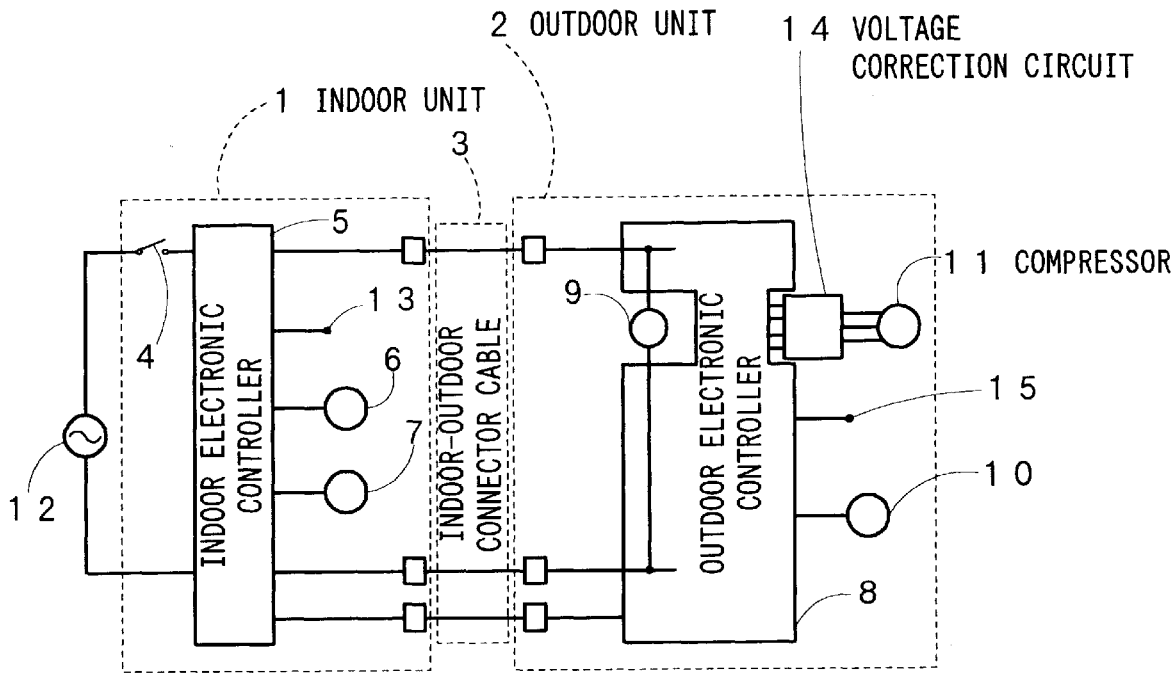
FIG. 1 is an electrical circuit diagram of a first embodiment of the separate-type air conditioner according to the present invention.

FIG. 1 is an electrical circuit diagram of a first embodiment 1 of the separate-type air conditioner according to the present invention, wherein an indoor unit 1 and an outdoor unit 2 are electrically connected to each other by means of an indoor-outdoor connector cable 3. The indoor unit 1 comprises an indoor electronic controller 5, a main switch 4 for connecting and disconnecting a commercial power supply 12 to the indoor electronic controller 5, an indoor fan motor 6 such as a transistor motor and louver motor 7 for driving upper and lower indoor blades, both of which are controlled by the indoor electronic controller 5, and an inlet temperature sensor serving as detection means 13 of room air temperature. The outdoor unit 2 comprises an outdoor electronic controller 8, a four-way valve 9 for switching the refrigerant flow path according to the refrigerating and heating cycles, an outdoor fan motor 10 such as an induction motor and a compressor 11, both of which are controlled by the outdoor electronic controller 8, a voltage correction circuit 14 mounted between the outdoor electronic controller 8 and the compressor 11, and an outside air temperature sensor serving as detection means 15 of outside air temperature.

Figure 2:
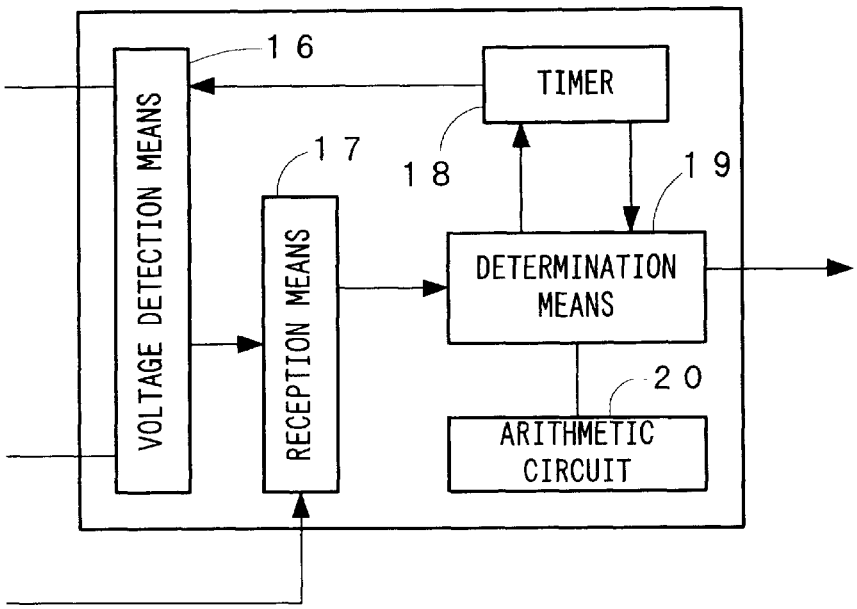
FIG. 2 is an electrical circuit diagram showing the internal configuration of part of FIG. 1.

FIG. 2 is an electrical circuit diagram showing the internal configuration of part of the voltage correction circuit 14. In the figure, 16 denotes voltage detection means for detecting the voltage of the commercial power supply 12 sent to the outdoor electronic controller 8 by the indoor electronic controller 5, 17 denotes reception means for receiving, as an input voltage signal, the voltage detected by the voltage detection means 16, 18 denotes a timer, 19 denotes determination means, and 20 denotes an arithmetic circuit.

In the separate-type air conditioner of the above configuration, the voltage corrected and determined by the voltage correction circuit 14 mounted in the outdoor electronic controller 8 is applied to the compressor 11 both during cooling and heating.

The interrelationships among the individual components of the separate-type air conditioner of the above configuration will be described below. The voltage of the commercial power supply 12 sent to the outdoor electronic controller 8 by the indoor electronic controller 5 is detected by the voltage detection means 16 of the voltage correction circuit 14 inserted between the outdoor electronic controller 8 and the compressor 11, and received as an input voltage signal by the reception means 17. At this time, the timer 18 comes into action. Then the determination means 19 and the arithmetic circuit 20 average the input voltages within a specified time period and detect the output voltage of the commercial power supply 12, that is, voltage fluctuations in the commercial power supply 12 sent to the outdoor electronic controller 8.

The arithmetic circuit 20 carries out arithmetic operations and determines the amplification factor (attenuation factor) of the output voltage so that the output voltage (optimum voltage) corresponding to the operating frequencies at rated voltage will be applied constantly to the compressor 11. And the resulting output voltage is applied to the compressor 11.

Here, the arithmetic circuit 20 may be a data table that represents the relationship between input voltages and the results of arithmetic operations.

The voltage of the commercial power supply 12 sent to the outdoor electronic controller 8 is detected by the voltage detection means 16 of the voltage correction circuit 14 at specified intervals by means of the timer 18.

Furthermore, the detection signal of the room air temperature detected by the inlet temperature sensor 13 serving as a detection means of room air temperature in the indoor unit 1 and the detection signal of the outside air temperature detected by the outside air temperature sensor 15 serving as a detection means of outside air temperature in the outdoor unit 2 are received by the reception means 17 of the outdoor unit 2. Using this data, the determination means 19 and arithmetic circuit 20 determine the loads on the separate-type air conditioner and add them to the operation results of the arithmetic circuit 20 as corrections for the working loads for use as a data table in determining the output voltage, for further optimization of the output voltage.

(Embodiment 2)

Figure 3:
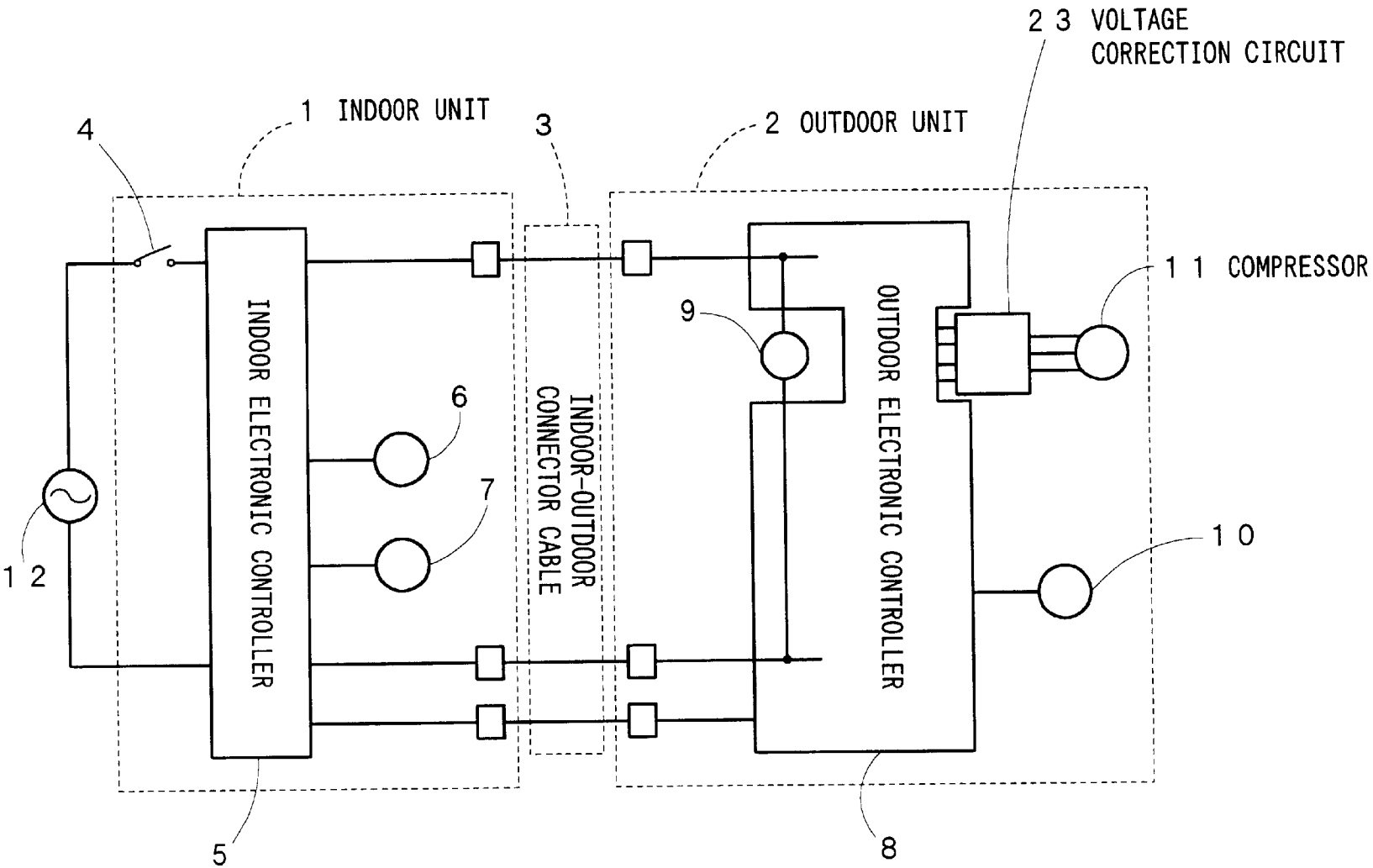
FIG. 3 is a block diagram showing an electric circuit of a second embodiment of the separate-type air conditioner according to the present invention.
Figure 13:
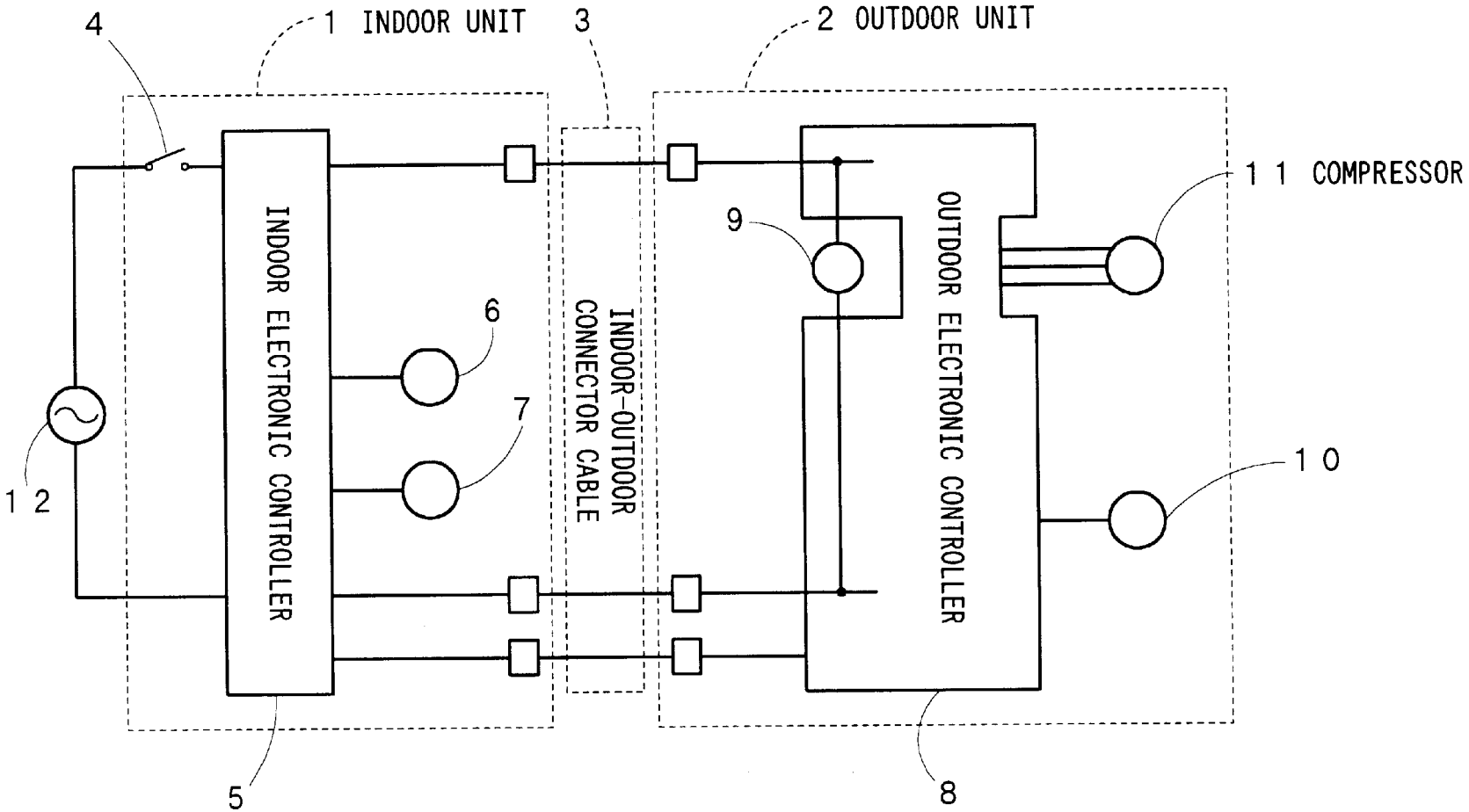
FIG. 13 is a block diagram showing the electric circuit of a conventional air conditioner.

A second embodiment 2 of the separate-type air conditioner shown in FIG. 3 comprises an indoor unit 1, an outdoor unit 2, and an indoor-outdoor connector cable 3 that connects them electrically, as is the case with the conventional air conditioner shown in FIG. 13. The only difference is that a voltage correction circuit 23 has been added as a voltage correction controller.

The voltage correction circuit 23 controls the duty of the commercial power supply 12, converts it into a power supply signal according to the voltage value of the commercial power supply 12, and applies the resulting power supply signal to the power supply circuit of the compressor 11. Specifically, as shown in FIG. 4, it comprises voltage detection means 24 and an arithmetic circuit 25 for correcting and determining the optimum output voltage to the compressor 11 by allocating the duty data for determination of the output voltage to the compressor 11 to a high-voltage region, rated-voltage region, or low-voltage region duty table according to the input voltage.

Now the operation of this separate-type air conditioner will be described below.

As shown in FIG. 3, with the main switch 4 of the indoor unit 1 on and with power being delivered to the indoor electronic controller 5 from the commercial power supply 12, when the user specifies operation start, the power from the commercial power supply 12 is delivered through the indoor electronic controller 5 to the outdoor electronic controller 8 and to the voltage correction circuit 23.

Figure 4:
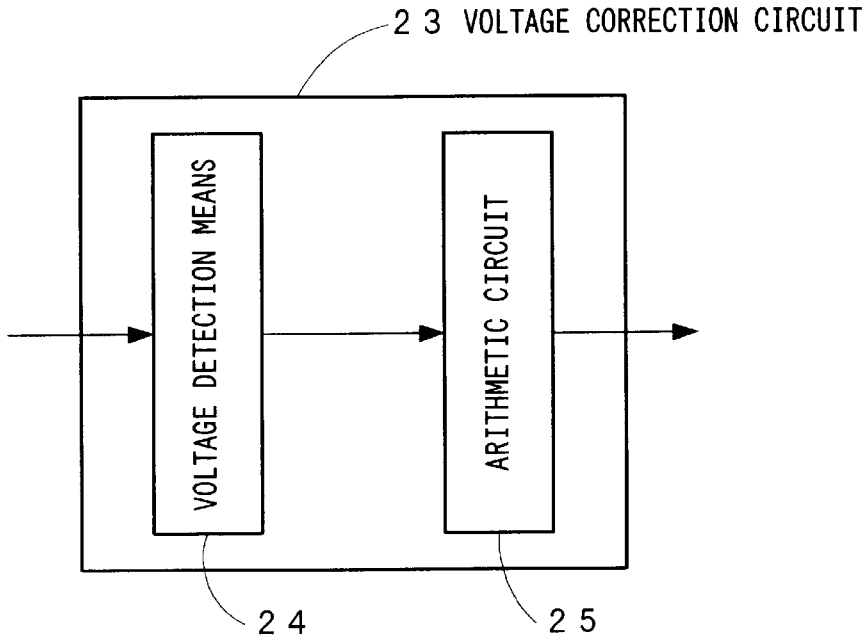
FIG. 4 is a block diagram showing the configuration of a voltage correction circuit of the second embodiment.

As shown in FIG. 4, the voltage detection means 24 detects the input voltage supplied to the outdoor electronic controller 8 from the commercial power supply 12 i.e., detects voltage fluctuations in the commercial power supply 12. The voltage detection means 24 outputs the detected input voltage as an input voltage signal to the arithmetic circuit 25.

The arithmetic circuit 25 allocates the duty data to the appropriate one of the duty tables based on the input voltage signal so that the output voltage to the compressor 11 will be the optimum output voltage corresponding to the operating frequencies at a voltage within rated range. The output voltage is corrected accordingly and the resulting optimum voltage is applied to the compressor 11.

More particularly, based on the input voltage delivered from the commercial power supply 12, the duty data for determining the pulse duty factor of the output voltage to the compressor 11 is allocated to one of the three duty tables: the high-voltage region duty table that decreases the average value of the output voltages by reducing the duty, rated-voltage region duty table that uses standard duty, or low-voltage region duty table that increases the average value of the output voltages by increasing the duty; to determine the optimum output voltage by correcting the average value of the output voltages to the compressor 11.

If the duty data is allocated to the high-voltage region duty table, the optimum output voltage is determined by decreasing the average value of the output voltages through duty reduction. If the duty data is allocated to the low-voltage region duty table, the optimum output voltage is determined by increasing the average value of the output voltages through duty increase. If the duty data is allocated to the rated-voltage region duty table, there is no need to correct the average value of the output voltages because the given duty is standard duty, and thus the given output voltage is adopted as the optimum output voltage.

With the present separate-type air conditioner, not only during a start-up as described above, but also during heating and cooling, the optimum output voltage corrected and determined by the voltage correction circuit 23 in a manner similar to that described above is constantly applied to the compressor 11.

Although the second embodiment 2 described above has the voltage detection means 24 and arithmetic circuit 25 configured to correct and determine the optimum output voltage to the compressor 11 by allocating the duty data to one of the three duty tables: the high-voltage region duty table, rated-voltage region duty table, or low-voltage region duty table, it is also possible to omit the rated-voltage region duty table for the purpose of simplicity and allocate the duty data to either the high-voltage region duty table or low-voltage region duty table.

(Embodiment 3)

Figure 6:
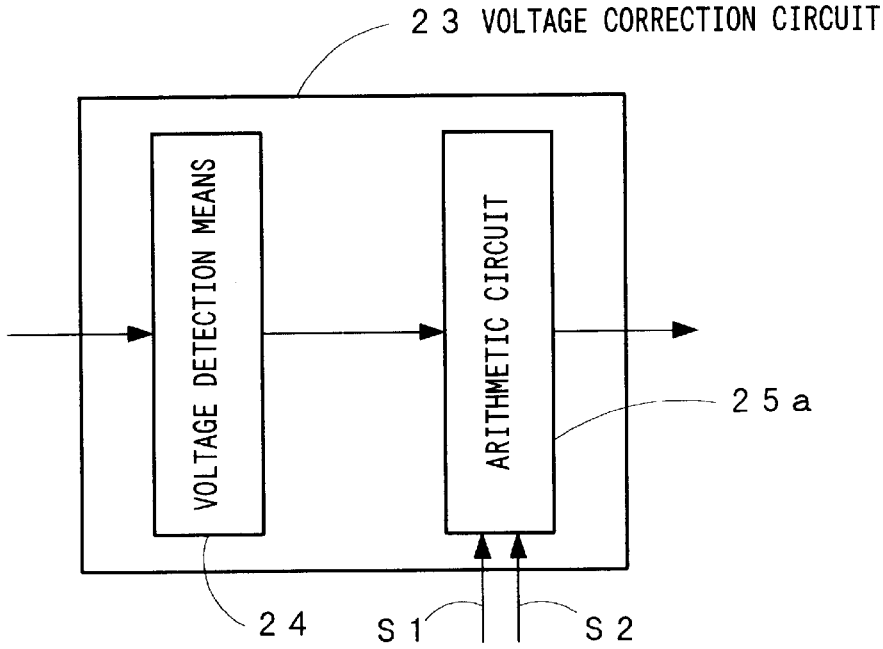
FIG. 6 is a block diagram showing the configuration of the voltage correction circuit of the third embodiment.
Figure 5:
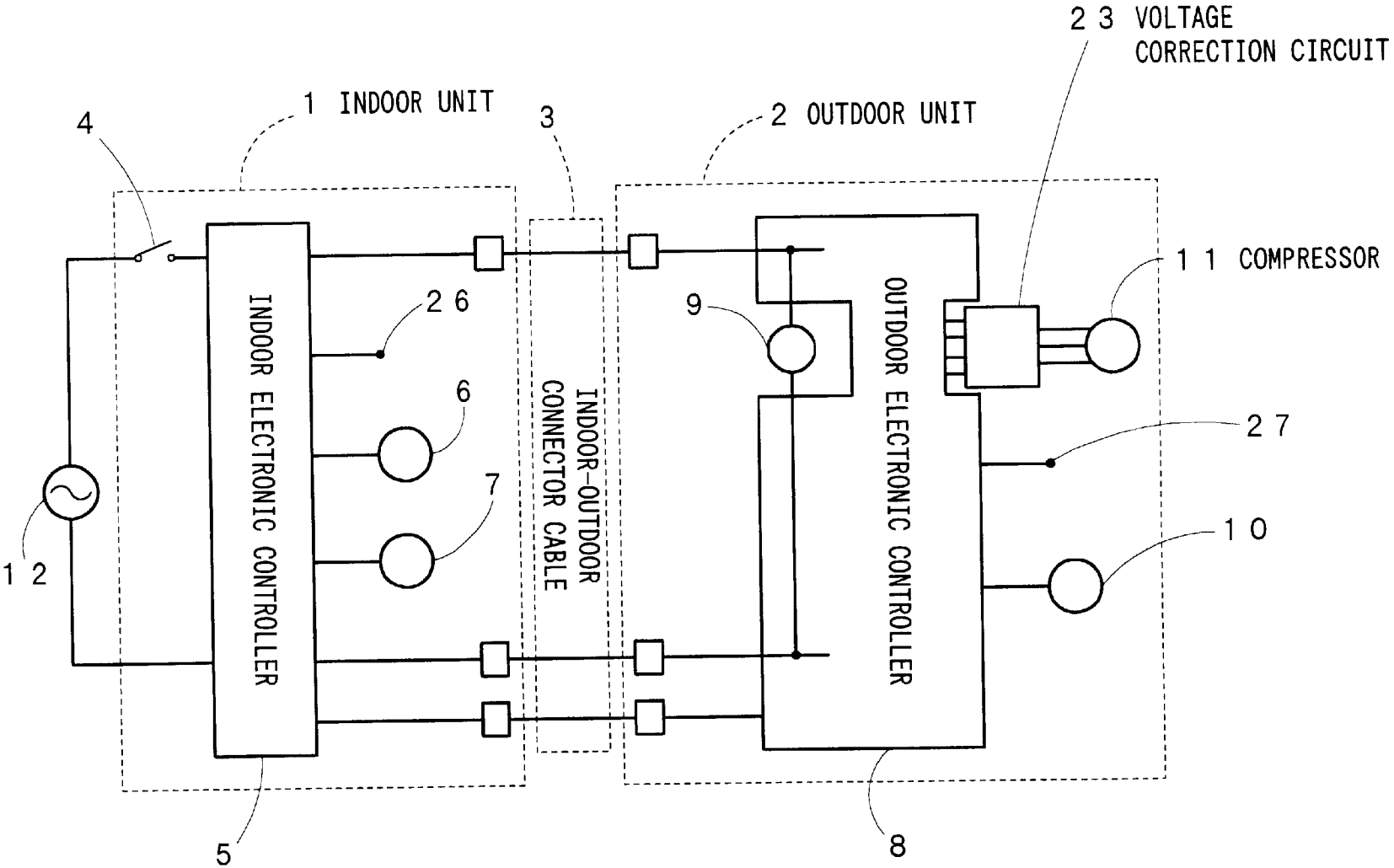
FIG. 5 is a block diagram showing an electric circuit of a third embodiment of the separate-type air conditioner according to the present invention.

A third embodiment 3 of the separate-type air conditioner according to the present invention is similar to the second embodiment 2 described above except that room air temperature detection means 26 and outside air temperature detection means 27 are provided as load condition detection means as shown in FIG. 5 and that the voltage correction controller 23 has been configured to correct and determine the optimum output voltage to the compressor 11 by changing the duty data based on the working loads (load conditions) as shown in FIG. 6.

The voltage correction controller 23 is configured by a voltage detection means 24 and arithmetic circuit 25*a*. The arithmetic circuit 25*a* has a shift amount data table that contains the amounts to shift the duty data according to the working loads.

Now, the operation of this separate-type air conditioner will be described below.

As shown in FIG. 6, a room air temperature detection signal S1 detected by the inlet temperature sensor serving as the room air temperature detection means 26 and an outside air temperature detection signal S2 detected by the outside air temperature sensor serving as the outside air temperature detection means 27 are entered in the arithmetic circuit 25*a*.

The arithmetic circuit 25*a* calculates the working loads from the room air temperature detection signal S1 and outside air temperature detection signal S2, looks up the amount of shift in the duty data that corresponds to the calculated working loads in the shift amount data table, adds the amount of shift to the duty data as corrections for the working loads to further optimize the output voltage, and determines the optimum output voltage to the compressor 11.

In addition to the capabilities of the second embodiment 2, this configuration provides the capability to detect the load conditions of the air conditioner, which makes it possible to further optimize the output voltage to the compressor 11 by taking into consideration the effect of the load conditions on the compressor, and thus enables efficient operation appropriate to the load conditions.

Although the third embodiment 3 configures the voltage correction controller 23 to modify the duty data based on the load conditions of the air conditioner detected by the load condition detection means and correct and determine the optimum output voltage to the compressor 11, the load conditions of the air conditioner could also be detected by a voltage/current detection means for detecting the output voltage and output current to the compressor. Then the voltage correction controller 23 could modify the duty data based on the output voltage and output current detected by the voltage/current detection means and optimize the output voltage to the compressor 11 taking into consideration the effect of the load conditions on the output voltage to the compressor 11.

Although the second and third embodiments 2 and 3 use the voltage detection means 24 to detect the output voltage from the outdoor electronic controller 8, the voltage detection means 24 could also detect the output voltage to the compressor 11 without problems.

(Embodiment 4)

Figure 7:
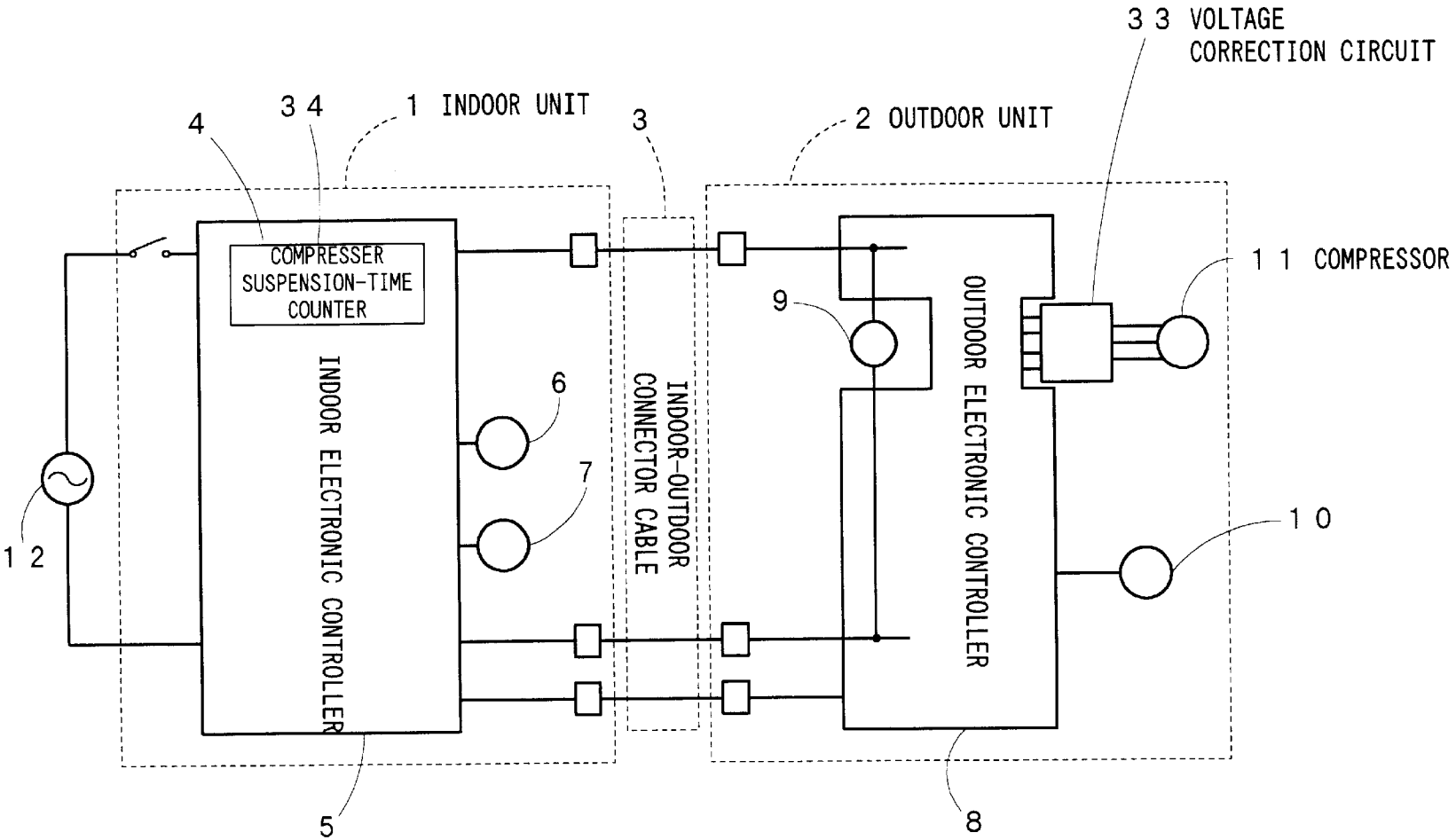
FIG. 7 is a block diagram showing the electric circuit of a fourth embodiment of the separate-type air conditioner according to the present invention.

A fourth embodiment 4 of the separate-type air conditioner shown in FIG. 7 comprises an indoor unit 1, an outdoor unit 2, and an indoor-outdoor connector cable that connects them electrically, as is the case with the conventional air conditioner shown in FIG. 13. The difference is that a voltage correction circuit 33 serving as a voltage correction controller and a compressor suspension-time counter 34 for measuring the suspension periods of the compressor 11 have been added.

The voltage correction circuit 33 applies the power supply signal set according to the voltage value of the commercial power supply 12 at a start-up and corrected based on the suspension period of the compressor 11 to the power supply circuit of the compressor 11. Specifically, it comprises a voltage detection circuit 35, reception means 36, and an arithmetic circuit 37. The compressor suspension-time counter 34 is installed in the indoor electronic controller 5.

Now a start-up operation of the separate-type air conditioner will be described below.

It is assumed that the suspension period of the compressor 11 was sufficiently long and that the compressor 11 is started in a pressure-balanced state.

As shown in FIG. 7, with the main switch 4 of the indoor unit 1 on and with power being delivered to the indoor electronic controller 5 from the commercial power supply 12, when the user specifies operation start, the power from the commercial power supply 12 is delivered through the indoor electronic controller 5 to the outdoor electronic controller 8 and to the voltage correction circuit 33.

Figure 8:
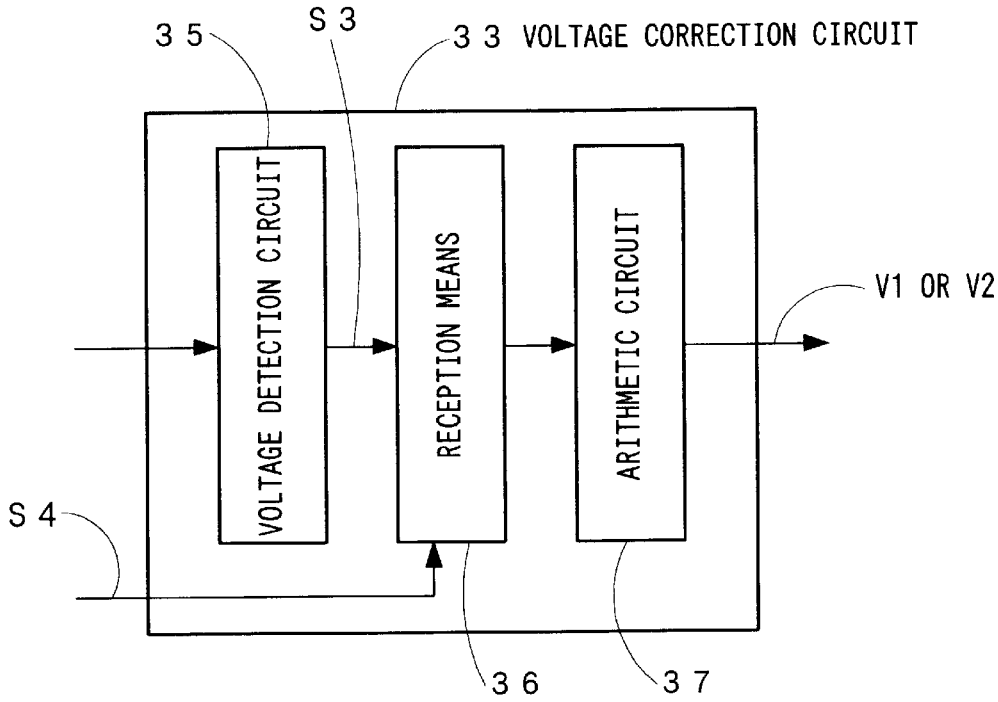
FIG. 8 is a block diagram showing the configuration of the voltage correction circuit of the fourth embodiment.

As shown in FIG. 8, the voltage detection circuit 35 detects the input voltage supplied to the outdoor electronic controller 8 from the commercial power supply 12 at a start-up i.e., detects voltage fluctuations in the commercial power supply 12. Then the voltage detection circuit 35 outputs the detected input voltage as a power supply voltage signal S3 to the reception means 36.

The reception means 36 receives the power supply voltage signal S3 and the suspension-period signal S4 that was read from the compressor suspension-time counter 34 under instructions from the arithmetic circuit 37 and that represents the suspension period of the compressor 11, and outputs them to the arithmetic circuit 37.

The arithmetic circuit 37 modifies the duty of the input voltage delivered from the commercial power supply 12 according to the power supply voltage signal S3 so that the output voltage to the compressor 11 will be the optimum output voltage corresponding to the operating frequencies at a voltage within rated range, and starts the compressor 11 by applying the optimum output voltage V1 to the power supply circuit of the compressor 11. In this example, the arithmetic circuit 37 detects, based on the suspension-period signal S4, that the suspension period of the compressor 11 was sufficiently long and assumes that the compressor 11 is in a pressure-balanced state, and thus determines that there is no need to correct the optimum output voltage V1 for the suspension period of the compressor 11.

Since the compressor 11 is pressure balanced, it starts normally at the optimum output voltage V1 without corrections and starts to compress the refrigerant.

If the user specifies operation stop during the operation of the compressor 11, the indoor electronic controller 5 stops the compressor 11 by disconnecting the outdoor electronic controller 8 from the commercial power supply 12 by means of the main relay (not shown).

When the compressor 11 stops, the compressor suspension-time counter 34 starts counting the suspension period of the compressor 11.

Now the restart operation of this separate-type air conditioner will be described below.

If the user specifies operation start to restart the compressor 11 within a short period of time (for example, about 1 minute) after the compressor 11 stops, the indoor electronic controller 5 activates the main relay (not shown) and power is delivered from the commercial power supply 12 through the indoor electronic controller 5 to the outdoor electronic controller 8 and to the voltage correction circuit 33.

As is the case with the start-up operation described above, the voltage detection circuit 35 detects the input voltage supplied to the outdoor electronic controller 8 from the commercial power supply 12 and outputs a power supply voltage signal S3 to the reception means 36.

The reception means 36 receives the power supply voltage signal S3 and the suspension-period signal S4 that was read from the compressor suspension-time counter 34 and that represents the suspension period of the compressor 11, and outputs them to the arithmetic circuit 37.

Based on the suspension-period signal S4 from the compressor suspension-time counter 34, the arithmetic circuit 37 corrects the optimum output voltage V1 that was set according to the power supply voltage signal S3 in such a way that the output voltage to the compressor 11 would be the optimum output voltage corresponding to the operating frequencies at a voltage within rated range, and restarts the compressor 11 by applying the resulting optimum output voltage V2 to the power supply circuit of the compressor 11.

More particularly, if the suspension period of the compressor 11 is short (for example, less than 1 minute), the compressor 11 is not pressure balanced and the optimum output voltage V1 set according to the power supply voltage signal S3 will not provide sufficient starting torque, thus the arithmetic circuit 37 increases the average value of the optimum output voltages V1 (for example, increases the average value of the output voltages by increasing the duty) based on the suspension-period signal S4 and restarts the compressor 11 by applying the resulting optimum output voltage V2 to the power supply circuit of the compressor 11. The amount of correction made to the average value of the optimum output voltages V1 based on the suspension-period signal S4 are set, for example, to decrease with increase in the suspension period.

If the suspension period of the compressor 11 is sufficiently long, the compressor 11 is pressure balanced and the optimum output voltage V1 alone can start the compressor 11, thus no correction is made to the average value of the optimum output voltages V1.

Both during cooling and heating, the optimum output voltage determined by the voltage correction circuit 33 is applied to the compressor 11.

This configuration makes it possible to reduce the effect of the voltage fluctuations in the commercial power supply 12 on the output voltage to the compressor 11 and improve the starting force of the compressor 11 taking into consideration the loads on the compressor 11 at the start-up.

(Embodiment 5)

Figure 10:
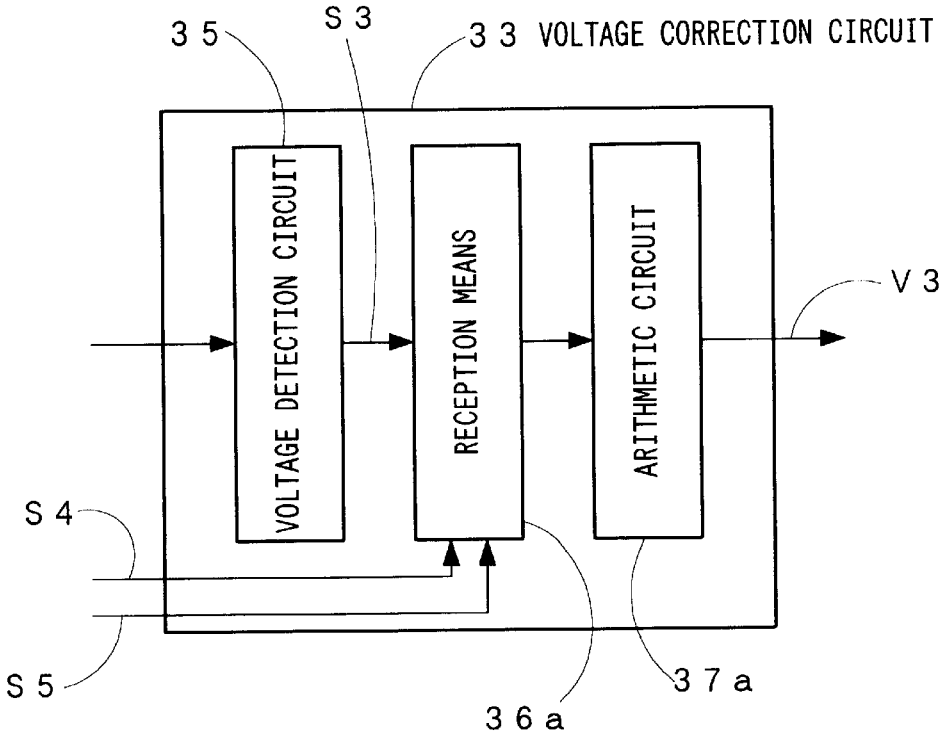
FIG. 10 is a block diagram showing the configuration of the voltage correction circuit of the fifth embodiment.
Figure 9:
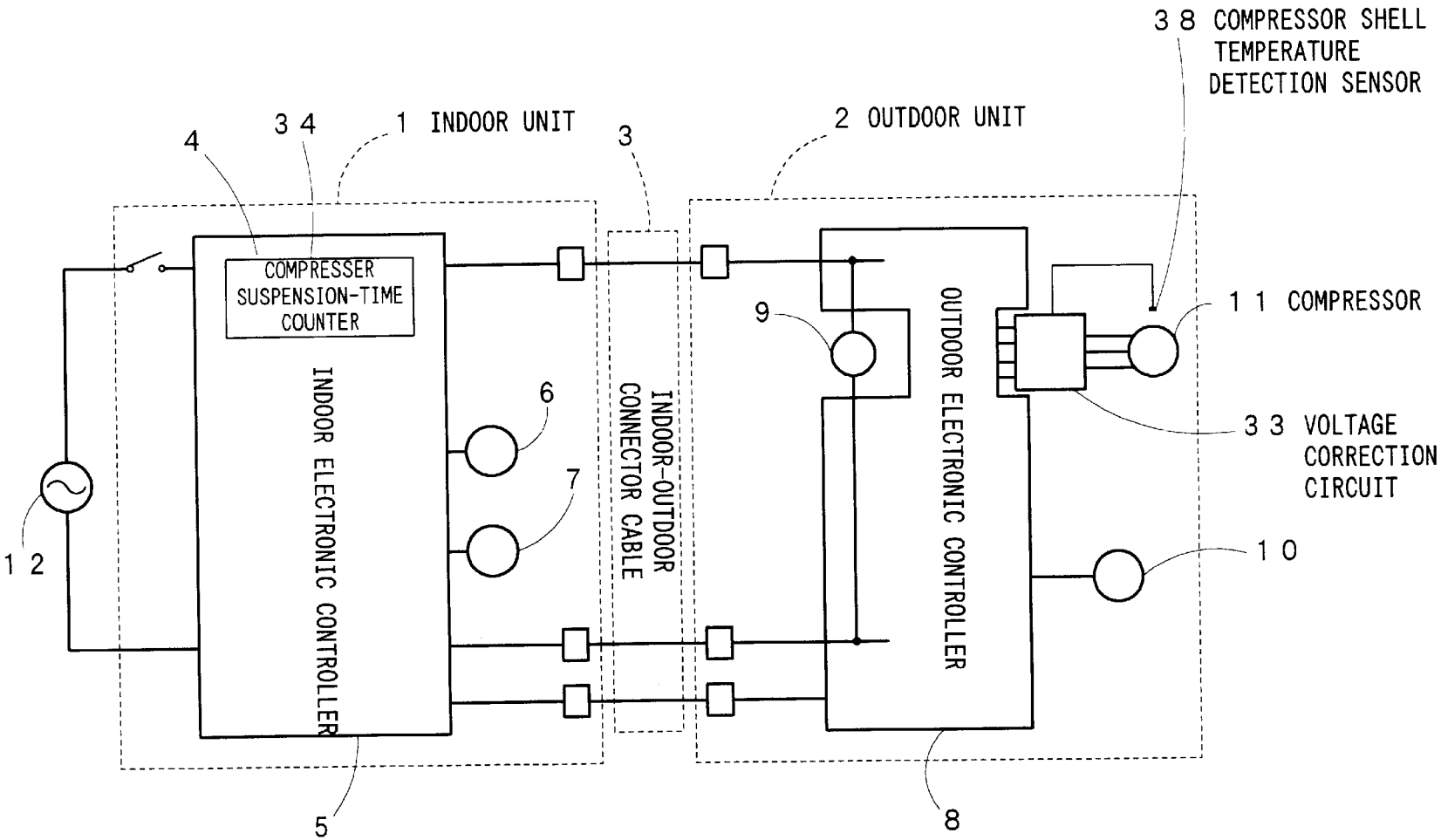
FIG. 9 is a block diagram showing the electric circuit of a fifth embodiment of the separate-type air conditioner according to the present invention.

A fifth embodiment 5 of the separate-type air conditioner according to the present invention is similar to the fourth embodiment 4 described above except that a compressor shell temperature detection means 38 is provided for detecting the shell temperature of the compressor 11 as shown in FIG. 9, and that the voltage correction circuit 33 has been configured to determine the optimum output voltage to the compressor 11 by correcting the power supply signal set according to the voltage value of the commercial power supply 12, based on the detection signal S5 from the compressor shell temperature detection means 38, as shown in FIG. 10.

The voltage correction circuit 33 comprises a voltage detection circuit 35, reception means 36*a,* and arithmetic circuit 37*a.*

Now the restart operation of this separate-type air conditioner will be described below.

The power supply voltage signal S3 from the voltage detection circuit 35, suspension-period signal S4 of the compressor 11 from the compressor suspension-time counter 34, and detection signal S5 of the shell temperature of the compressor 11 detected by the compressor shell temperature detection means 38 are entered in the arithmetic circuit 37*a* through the reception means 36*a*.

The arithmetic circuit 37*a* temporarily determines an optimum output voltage V2, based on the suspension-period signal S4 from the compressor suspension-time counter 34, by correcting the optimum output voltage V1 that was set according to the input voltage signal S3 in such a way that the output voltage to the compressor 11 would be the optimum output voltage corresponding to the operating frequencies at a voltage within rated range, determines the optimum output voltage V3 finally by correcting the temporary optimum output voltage V2 based on the detection signal S5 from the compressor shell temperature detection means 38, and restarts the compressor 11 by applying the final optimum output voltage V3 to the power supply circuit of the compressor 11.

More particularly, if the shell temperature of the compressor 11 is low (for example, −15° C. or so), the viscosity of the compressor 11 motor oil is high resulting in insufficient starting torque, thus the final optimum output voltage V3 is determined by increasing the average value of the temporary optimum output voltages V2 (for example, increasing the average value of the output voltages by increasing duty) based on the detection signal S5 from the compressor shell temperature detection means 38, and the compressor 11 is restarted by the application of the final optimum output voltage V3 to the power supply circuit of the compressor 11. The amount of correction made to the average value of the optimum output voltages V2 based on the detection signal S5 are set, for example, to increase with decrease in the shell temperature.

This configuration makes it possible further improve the starting force of the compressor by detecting the shell temperature of the compressor 11 and determining the optimum output voltage to the compressor 11 taking into consideration the magnetic characteristics of the dc motor.

(Embodiment 6)

Figure 11:
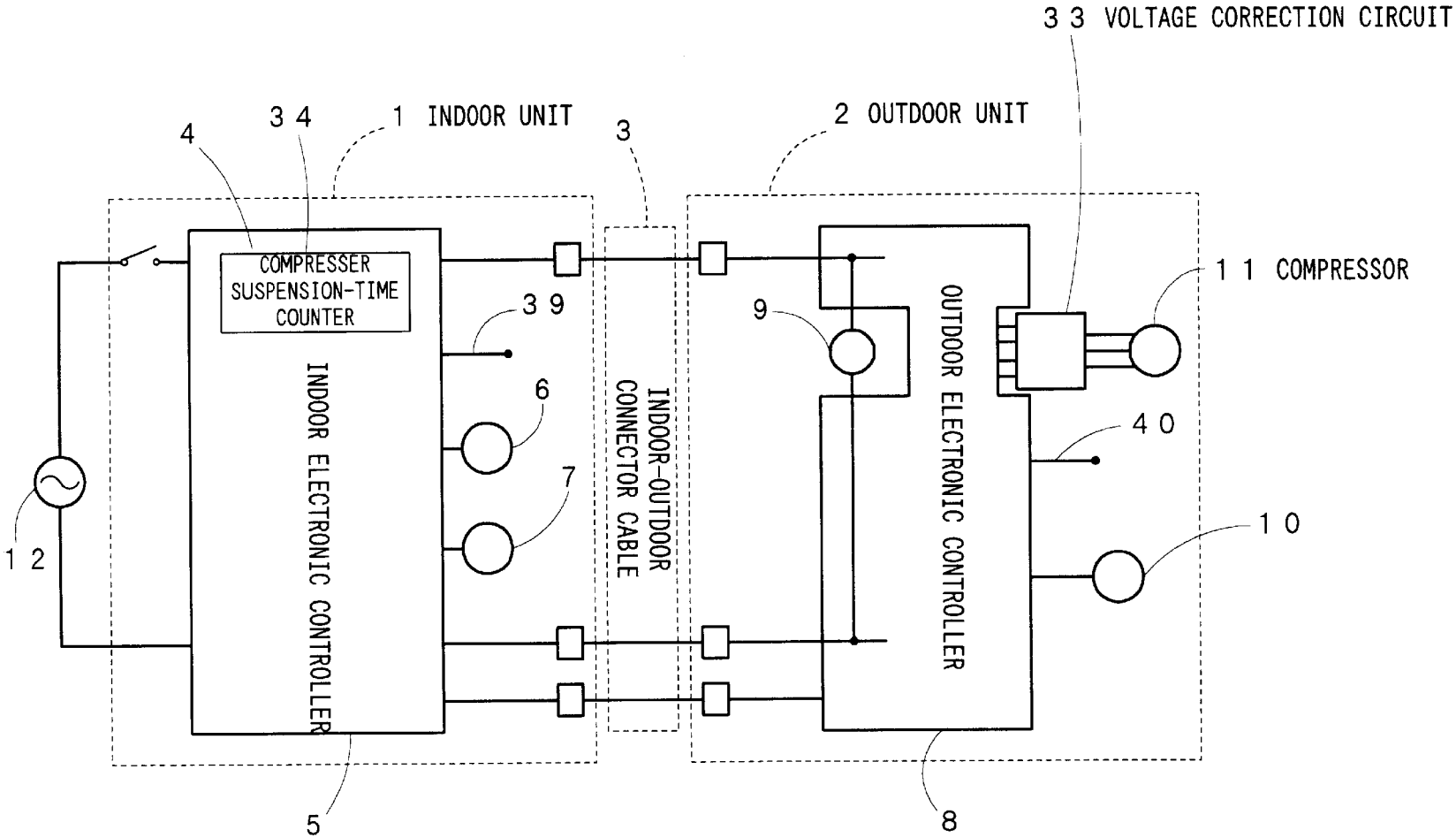
FIG. 11 is a block diagram showing the electric circuit of a sixth embodiment of the separate-type air conditioner according to the present invention.
Figure 12:
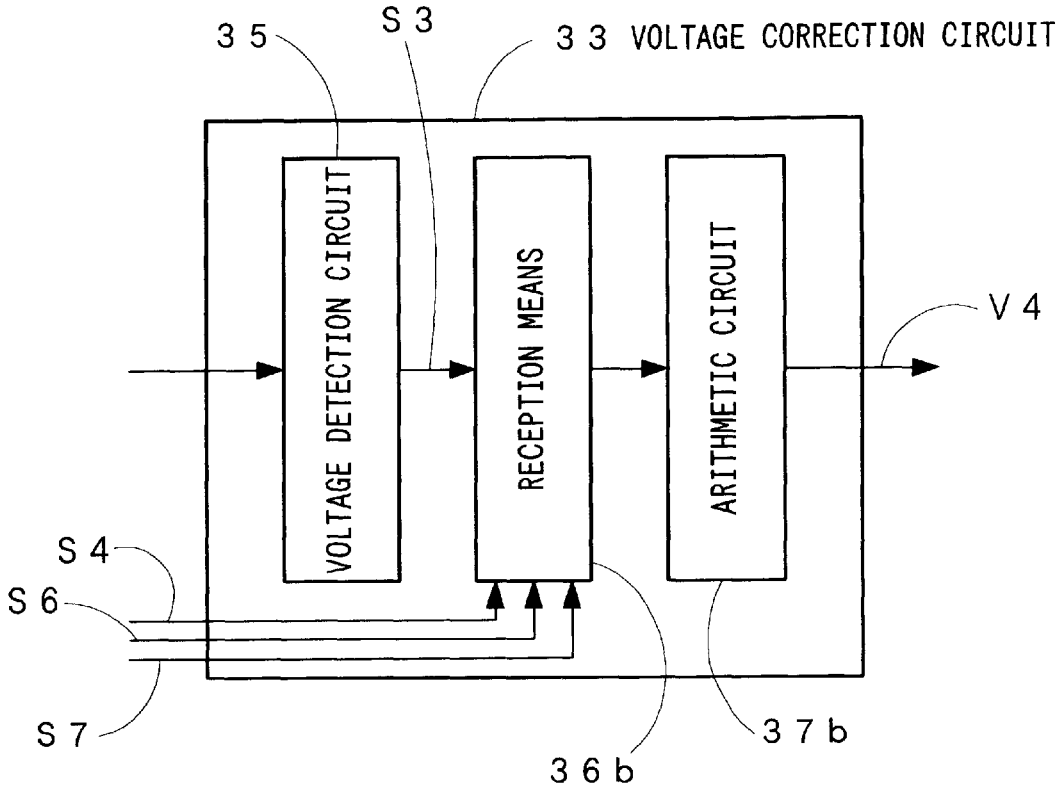
FIG. 12 is a block diagram showing the configuration of the voltage correction circuit of the sixth embodiment.

A sixth embodiment 6 of the separate-type air conditioner according to the present invention is similar to the fourth embodiment 4 except that an inlet temperature sensor 39 serving as a room air temperature detection means and outside air temperature sensor 40 serving as an outside air temperature detection means are provided as shown in FIG. 11, and that the voltage correction circuit 33 has been configured to correct and determine the optimum output voltage to the compressor 11 based on the room air temperature detection signal S6 from the inlet temperature sensor 39 and outside air temperature detection signal S7 from the outside air temperature sensor 40 as shown in FIG. 12.

The voltage correction circuit 33 comprises a voltage detection circuit 35, reception means 36*b,* and arithmetic circuit 37*b.*

Now, a restart operation of this separate-type air conditioner will be described below.

As shown in FIG. 12, the power supply voltage signal S3 from the voltage detection circuit 35, suspension-period signal S4 of the compressor 11 from the compressor suspension-time counter 34, room air temperature detection signal S6 from the inlet temperature sensor 39, and outside air temperature detection signal S7 from the outside air temperature sensor 40 are entered in the arithmetic circuit 37*b* through the reception means 36*b*.

The arithmetic circuit 37*b* temporarily determines an optimum output voltage V2 based on the suspension-period signal S4 from the compressor suspension-time counter 34 by correcting the optimum output voltage V1 that was set according to the power supply voltage signal S3 in such a way that the output voltage to the compressor 11 would be the optimum output voltage corresponding to the operating frequencies at a voltage within rated range, determines the optimum output voltage V4 finally by correcting the temporary optimum output voltage V2 based on the room air temperature detection signal S6 and outside air temperature detection signal S7, and restarts the compressor 11 by applying the final optimum output voltage V4 to the power supply circuit of the compressor 11.

More particularly, if it is considered that a large difference between the room air temperature and outside air temperature will result in insufficient starting torque, based on the room air temperature detection signal S6 and outside air temperature detection signal S7, the average value of the output voltages is increased, for example, by increasing the duty.

This configuration makes it possible to calculate the loads on the compressor 11 from the difference between the room air temperature and outside air temperature just before the start-up, based on the room air temperature detection signal S6 and outside air temperature detection signal S7, and thus to optimize the output voltage to the compressor 11 by correcting the optimum output voltage to the compressor, taking into consideration the characteristics of the refrigerant at the start-up after a long-term shutdown.

Although the fourth and fifth embodiments 4 and 5 described above correct the input voltage from the commercial power supply 12 by controlling its duty, other methods such as increasing/decreasing the peak values of the input voltage from the commercial power supply 12 will have the same effect.

What is claimed is:

1. An operation control method of an air conditioner wherein a compressor (11) for a refrigerating cycle is activated by the steps of:

controlling duty of a commercial power supply (12);

converting the duty into a power supply signal according to a voltage value of the commercial power supply (12) initially applied to the compressor (11); and applying a resulting power supply signal to a power supply circuit of said compressor (11).

2. An air conditioner which is activated by controlling duty of a commercial power supply (12) initially applied to a compressor (11), converting the duty into a power supply signal according to a voltage value of the commercial power supply (12), and applying a resulting power supply signal to a power supply circuit of the compressor (11), wherein a voltage correction controller is provided in order for correcting and determining an optimum output voltage to said compressor (11) by allocating a duty data for determination of the output voltage to said compressor (11) to one of high-voltage, rated-voltage and low-voltage region tables or to one of high-voltage and low-voltage region tables according to input voltages.

3. The air conditioner according to claim 2, further comprising detection means (26,27) for detecting load conditions, wherein the voltage correction controller is configured to correct and determine the optimum output voltage to the compressor (11) by modifying the duty data based on said load conditions.

4. The air conditioner according to claim 2, further comprising voltage/current detection means for detecting the output voltage and the output current to the compressor (11), wherein the voltage correction controller is configured to correct and determine the optimum output voltage to said compressor (11) by modifying the duty data based on the output voltage and output current detected by said voltage/current detection means.

* * * * *